United States Patent [19]

Yamamoto

[11] Patent Number: 4,934,291

[45] Date of Patent: Jun. 19, 1990

[54] NEEDLE THREAD SUPPLY DEVICE IN TWO NEEDLE SEWING MACHINE WITH ONE NEEDLE PAUSE FUNCTION

[75] Inventor: Yuji Yamamoto, Tokyo, Japan

[73] Assignee: Juki Corporation, Chofu, Japan

[21] Appl. No.: 353,741

[22] Filed: May 18, 1989

[30] Foreign Application Priority Data

May 31, 1988 [JP] Japan ..... 63-135151

[51] Int. Cl.[5] ..... D05B 1/08; D05B 47/04

[52] U.S. Cl. ..... 112/163; 112/275; 112/302

[58] Field of Search ..... 112/163, 164, 165, 166, 112/167, 121.11, 121.12, 121.13, 154, 241, 242, 243, 255, 274, 275, 452, 354, 302

[56] References Cited

U.S. PATENT DOCUMENTS 3,545,390 12/1970 Kucera et al. ..... 112/164
4,178,862 12/1979 Bianchi et al. ..... 112/121.11
4,526,114 7/1985 Martell et al. ..... 112/121.11 X
4,569,297 2/1986 Düsch ..... 112/121.11 X
4,736,699 4/1988 Dobner et al. ..... 112/121.11 X
4,815,404 3/1989 Ellermann et al. ..... 112/121.11

FOREIGN PATENT DOCUMENTS 232577 12/1984 Japan ..... 112/241
75082 4/1985 Japan ..... 112/241

*Primary Examiner*—Werner H. Schroeder
*Assistant Examiner*—David K. Suto
*Attorney, Agent, or Firm*—Morgan & Finnegan

[57] ABSTRACT

A two needle sewing machine having a one needle pause function wherein a needle thread supply device is provided. The needle thread supply device includes a thread guide element. The thread guide element is reciprocally movable in association with a drive means to change the length of the thread path for controlling the tension of the thread.

10 Claims, 4 Drawing Sheets

NEEDLE THREAD SUPPLY DEVICE IN TWO NEEDLE SEWING MACHINE WITH ONE NEEDLE PAUSE FUNCTION

BACKGROUND OF THE INVENTION

1. Field of the Invention

This invention relates generally to a needle thread supply device, in a two needle sewing machine with a single needle pause function, and more particularly to such a needle thread supply device which uses a needle thread control technique.

2. Prior Art

A sewing machine having two needles arranged in parallel with each other, and a mechanism for temporarily holding one of the needles in an inoperative condition, has heretofore been known as disclosed in U.S. Pat. No. 3,545,390. Such an apparatus may, of course, be used for sewing together two fabrics. For example, with reference to FIG. 5 of the instant application (which illustrates a stitching pattern) when two fabrics a1, a2 are placed one over the other and such a prior device is used to form two parallel seams Ti, To, only one needle (i.e., the needle located at the outside of the corner of the fabrics laid one over another) sews a seam To1–To2 (in the shaded area in FIG. 5) in seaming an angular portion. Meanwhile, the other needle (i.e., the needle located at the inside of the corner of the fabrics) is maintained in a pause condition.

When the needle located at the inside of the corner is unoperated, the thread which is inserted in the entry of the needle is not consumed as the seam is not formed thereby. However, in the sewing machine of the above type, provided that one of the needles, that is, the needle inside of the corner is paused, the paused needle thread is caught between the fabrics and the pressor foot and is then pulled out of the needle inside of the corner simultaneously with movement of the fabrics.

It is apparent from the foregoing that the needle thread is inevitably drawn from the thread tension unit when the seam To1–To2 outside of the corner is made to a considerable extent.

As a result, a disadvantage derived from such a conventional mechanism is that when the needle which has been paused is re-operated to form a seam starting from an apex (stitch) Ti, the needle thread drawn from the thread tension unit is not subjected to thread tension, thereby having the needle thread bulged out of the back of the fabrics or raised from the fabrics.

SUMMARY OF THE INVENTION

In view of the above described disadvantages of the prior art, it is an object of the invention to provide a needle thread supply device in a two needle sewing machine with a one needle pause function which results in neat and attractive corner seams without unwinding the needle thread from the thread tension unit when one of the needles is paused.

It is another object of the invention to provide a needle thread supply device in a two needle sewing machine with a one needle pause function which maintains proper tension on the thread path so that a proper feed or supply of needle thread may be maintained.

According to the invention, a two needle sewing machine is provided which includes two needles independently driven and arranged in parallel with each other to perform a one needle pause function for pausing the desired needle, and a reciprocally moving thread guide element projected to lengthen and shorten a thread path extended between a thread tension unit and a paused needle. The guide element may be reciprocally driven in cooperation with a drive or pause timing mechanism for controlling the sewing machine needle by means of appropriate drive mechanisms such as a solenoid coil and the like.

An advantage of the invention is that it provides a thread guide element which is reciprocally moved to lengthen and shorten the thread path thereby slackening and tensioning the thread path so that the needle thread is not unwound even if the seam extends for a long distance when the one needle is paused to prevent the needle thread from emerging out of the back of the fabric or bulged thereon.

BRIEF DESCRIPTION OF THE DRAWINGS

Other objects, features, and advantages of the invention will be apparent from the detailed descriptions of illustrative embodiments of the invention which will now be given in conjunction with the accompanying drawings, in which.

DETAILED DESCRIPTION OF THE DRAWINGS

Figure 1:
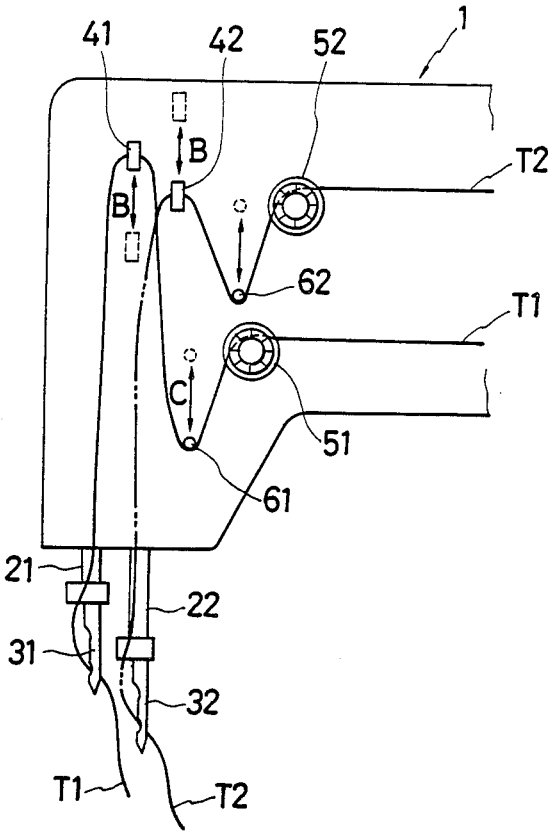
FIG. 1 is a schematic front view of one form of a thread needle supply device in a two needle sewing machine according to the invention and shows its machine head.

One embodiment of the inventive needle thread supply device in a two needle sewing machine with a one needle pause mechanism will be now described with reference to FIGS. 1 and 2. A pair of needle bars 21, 22 are provided with sewing-machine needles 31, 32 mounted at the lower ends thereof, in parallel with each other. The needles 31, 32 move reciprocally and vertically (arrow A in FIG. 2) in association with a main shaft of the sewing machine. The needle bars 21, 22 may be arranged as described in U.S. Pat. No. 3,545,390, incorporated herein by reference, in which one of the needles is selectively held in a pause condition by the one needle pause mechanism.

Thread tension units 51, 52 and thread take-up levers 41, 42 are provided on the respective paths of the needle threads T1, T2 supplied to sewing-machine needles 31, 32. The thread tension units 51, 52 are adapted for tensioning and slackening the threads passed therethrough from a supply source(not shown) by, for example, adjusting the sliding friction. The thread take-up levers 41, 42 are adapted for reciprocal movement in association with reciprocal movement of the needle bars 21, 22.

Thread guide elements 61, 62 (FIG. 1) are disposed between the respective thread tension units 51, 52 and the thread take-up levers 41, 42 on the thread paths T1, T2. The thread guide elements 61, 62 are adapted to reciprocally move transverse to and contact with the thread paths (in the direction of an arrow C) so that the routes through which the needle threads T1, T2 pass are changed to thereby change the lengths of the respective needle thread paths.

Figure 2:
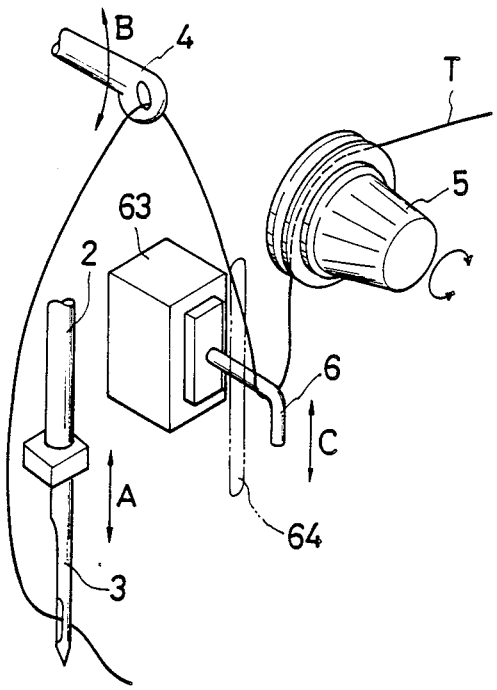
FIG. 2 is a perspective view of an essential part of the needle thread supply device and shows a path of the needle thread.

Referring to FIG. 2, which shows one of the thread paths, the thread guide element 6 (illustrative of parts 61 and 62 ("61;62") of FIG. 1) may take the form of a rod which is projected from a slot or long hole 64 formed in a sewing machine body 1 (FIG. 1). The thread guide element 6 is driven in the direction of the arrow C by a reciprocating drive means 63 such as a solenoid coil or the like. The thread path is defined by the needle thread which passes over the thread tension unit 5 (51;52) to the thread take-up lever 4 (41;42) through the thread guide element 6 and is led to the sewing-machine needle 3 (31;32) mounted on the needle bar 2 (21;22) having a needle entry in which the needle is inserted.

Figure 3:
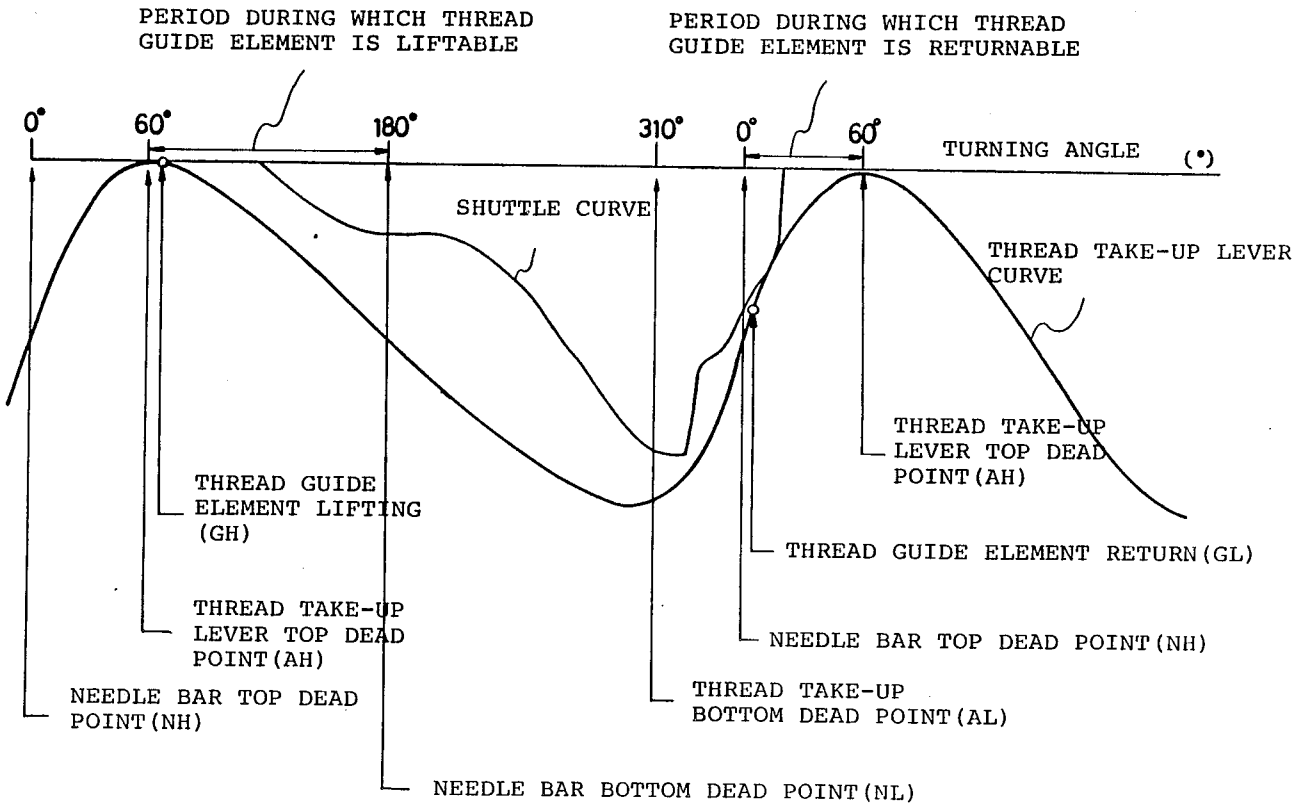
FIG. 3 is a motion and timing diagram explaining the operation of the thread guide element when one needle is paused.

The timing diagram of FIG. 3 illustrates the timing for the thread guide element 6 being lifted and returned. As shown therein, when the one needle is paused, the thread guide element 6 is lifted to a position indicated by dotted line in FIG. 1 to meet a point GH preferably immediately after a top dead point AH of the thread take-up lever 4. In this connection, it is noted that the lift timing GH of the thread guide element 6 can be freely set between the top dead point AH of the thread take-up lever 4 and a bottom dead point NL of the needle bar 2.

When the one needle is again driven or reoperated, the thread guide element 6 (FIG. 2) is returned to a position indicated by a solid line in FIG. 1 to meet a point GL, preferably immediately after a top dead point NH of the needle bar 2. In this connection, it is noted that the return timing GL of the thread guide element 6 can be freely set between the top dead point NH of the needle bar 2 and the top dead point AH of the needle take-up lever 4. The needle, as paused, is reconnected to a drive source of the sewing machine normally during the returning operation of the thread guide element 6.

Displacement of the thread guide element 6 from the lifted position to the returned position follows a change of the length of thread path associated with the paused needle. Thus, the needle drawn by the fabric can be absorbed by the needle thread slackened on the thread path to prevent the needle thread from being drawn from the needle tension unit 5, thereby maintaining or achieving a proper supply of needle thread when the one needle is again driven or reoperated.

Figure 4:
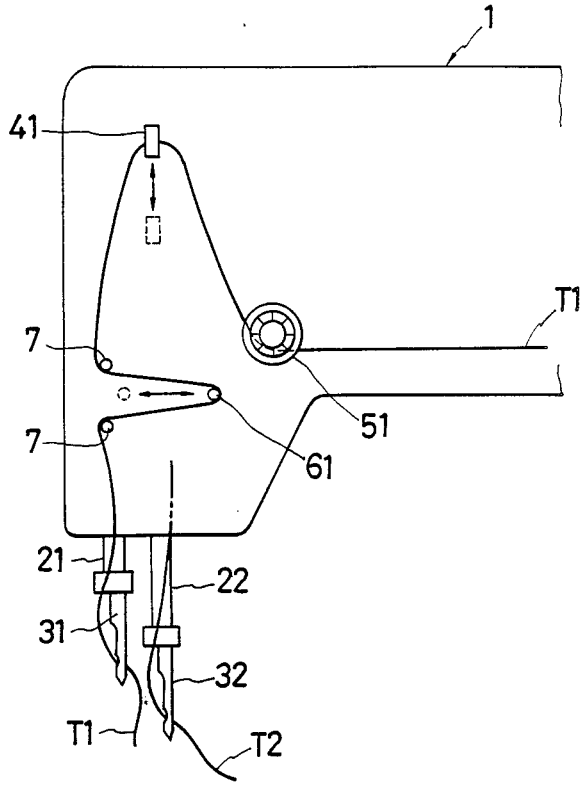
FIG. 4 is a schematic front view of another embodiment of the invention and shows the instant sewing machine head.

FIG. 4 shows another embodiment of the invention. For the purpose of simplification of explanation, only one of the thread paths T1 of the needle threads will be described.

According to the embodiment as shown in FIG. 4, the thread guide element 61 is formed on the thread path extended from the thread take-up lever 41 to the sewing-machine needle 31 mounted to the needle bar 21. Two pins 7 are formed on the same path so as to move the thread toward and away from the pins. Displacement of the thread guide element 61 in the thread path of the second embodiment is in the same manner as in the previous embodiment, whether the thread guide element is disposed before or after the thread take-up lever. As a result, a proper feed or supply of the needle thread is achieved when the one needle is paused.

Figure 5:
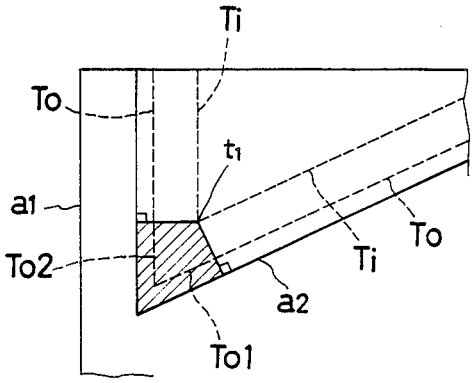
FIG. 5 is a front elevation of the fabric as sewed by the instant two needle sewing machine.

In operation, for formation of the seams shown in FIG. 5 in accordance with the aforementioned arrangement, the solenoid coil is activated when the one needle is paused at the apex $t_1$ to lift or return the thread guide element 6 disposed on the thread path on the part of the paused needle away from the thread path or to the return position.

Due to the fact that the needle thread on the thread path is caused to provide slack by lifting of the thread guide element 6, this slack is delivered to prevent the thread tension unit from unwinding the thread therefrom when the thread needle clamped between the fabric and a presser foot is moved with the fabric as the outer seam To1 is sewed by the other needle outside of the corner.

When the one needle inside of the corner is again driven after formation of the outer seam To1–To2, the solenoid coil is deactivated to return the thread guide element 6 to the lowered position so that the needle thread on the thread path is lengthened by passing the needle thread through the pins to thereby draw back the excess needle thread which has been unwound from the needle point.

For this reason, such poor sewing that the needle thread is emerged on the fabric or bulged out therefrom is not derived from reoperation of the one needle eve if sewing is done for a long distance when the one needle is paused.

While the invention has been described in detail above by way of reference to disclosed embodiments, it should be understood that the invention is not limited to the described embodiments, but should only be interpreted in accordance with the claims that follow.

What is claimed is:

1. In a two needle sewing machine with means for pausing one of two needles, a needle thread supply device comprising:

a thread tension unit;

a thread guide element disposed between said thread tension unit and said one needle, said thread guide element having means to reciprocally move to change a length of the thread path between said thread tension unit and said one needle; and drive means for reciprocally driving said thread guide element;

wherein said drive means moves said thread guide element when said one needle is paused from a first position where said thread guide element contacts said thread path to a second position where said guide element is away from said first position, and said guide element returns to said first position when said one needle is reoperated.

2. A needle thread supply device according to claim 1, wherein said drive means moves said guide element from said first position to said second position so as to slacken said thread path and from said second position to said first position so as to tension said thread path.

3. In a two needle sewing machine with means for pausing one of two needles, a needle thread supply device according to claim 1, wherein said one needle is reconnected to a main drive means of the sewing machine during a period of returning said thread guide element to said first position.

4. In a two needle sewing machine with means for pausing one of the needles, a needle thread feed device comprising:

a take-up lever, a thread guide element disposed between said take-up lever and said needle, said thread guide element having means to reciprocally move to change a length of a thread path between said take-up lever and said needle, and drive means for reciprocally driving said thread guide element.

5. A needle thread supply device according to claim 4, further comprising means for guiding the thread from said thread guide element to said needle.

6. A needle thread feed supply device according to claim 5, wherein said drive means moves said thread guide element, when said one needle is paused from a first position where said thread guide element contacts with said thread path to a second position where said guide element is away from said first position, and returns said guide element to said first position when said one needle is reoperated.

7. A needle thread feed device according to claim 6, wherein said drive means moves said guide element from said first position to said second position so as to slacken said thread path and returns said guide element to said first position so as to tension said thread path.

8. In a two needle sewing machine with means for pausing one of the needles, a needle thread supply device comprising:

a thread tension unit;

a take-up lever;

a thread guide element disposed between said thread tension unit and said take-up lever, said thread guide element having means to reciprocally move to change a length of the thread path between said thread tension unit and said take-up lever; and drive means for reciprocally driving said guide element;

wherein said drive means moves said thread guide element from a first position where said thread guide element contacts said thread path to a second position where said guide element is away from said first position when said one needle is paused, and returns said guide element to said first position when said one needle is reoperated.

9. In a two needle sewing machine with means for pausing one of two needles, a needle thread device according to claim 8, wherein said drive means moves said guide element from said first position to said second position so as to slacken said thread path and returns said guide element to said first position so as to tension said thread path.

10. In a two needle sewing machine with means for pausing one of two needles, a needle thread supply device according to claim 9, wherein said one needle is reconnected to a main drive means of the sewing machine during a period of returning said thread guide element to said first position.

* * * * *